US005336103A

United States Patent [19]

Herboldsheimer

[11] Patent Number: 5,336,103

[45] Date of Patent: Aug. 9, 1994

[54] FEMALE SOCKET-BASED MALE PLUG LOCKING DEVICE

[76] Inventor: John D. Herboldsheimer, 11028 S. Cambridge Pl., Parker, Colo. 80134

[21] Appl. No.: 112,611

[22] Filed: Aug. 26, 1993

[51] Int. Cl.[5] ..... H01R 4/50

[52] U.S. Cl. ..... 439/346; 439/265

[58] Field of Search ..... 439/346, 347, 348, 349, 439/345, 262, 263, 265, 268, 269, 270, 259

[56] References Cited

U.S. PATENT DOCUMENTS

| | | | |
|---|---|---|---|
| 1,593,985 | 7/1926 | Nielsen . | |
| 2,476,510 | 7/1949 | Rosner | 439/265 |
| 2,590,505 | 3/1952 | Carlsen | 439/349 |
| 2,738,483 | 3/1956 | McLean | 439/263 |
| 2,872,654 | 2/1959 | Smith . | |
| 3,543,218 | 11/1970 | Archer . | |
| 4,136,919 | 1/1979 | Howard et al. | 439/346 |
| 4,145,104 | 3/1979 | Fischer . | |
| 4,453,793 | 6/1984 | Panek et al. . | |
| 4,530,556 | 7/1985 | Bonus . | |
| 4,867,697 | 9/1989 | Borges | 439/265 |

FOREIGN PATENT DOCUMENTS

| | | |
|---|---|---|
| 0037014 | 10/1981 | European Pat. Off. . |
| 0076063 | 4/1983 | European Pat. Off. . |
| 921460 | 11/1954 | Fed. Rep. of Germany . |
| 257146 | 6/1988 | Fed. Rep. of Germany . |

*Primary Examiner*—Gary F. Paumen
*Assistant Examiner*—Hien D. Vu
*Attorney, Agent, or Firm*—John R. Flanagan

[57] ABSTRACT

A male plug locking device includes an inner socket body, elongated electrical contact elements disposed on the inner socket body, an outer housing disposed over the inner socket body and electrical contact elements, and locking cam elements disposed between the outer housing and inner socket body. The inner socket body is configured for receiving and engaging contact prongs of a male plug and for providing electrical connections with ends of the conductor wires of an electrical cord. The outer housing is mounted on the inner socket body to undergo movement relative thereto between first and second axially displaced positions. The locking cam elements overlie the electrical contact elements on the inner socket body and the contact prongs of the male plug and are operable for respectively clamping the contact prongs against the electrical contact elements and for releasing the contact prongs from the electrical contact elements in response to movement of the outer housing between the first and second axially displaced positions relative to the inner socket body so as to thereby prevent and permit disconnection of the male plug from the inner socket body.

20 Claims, 5 Drawing Sheets

Fig. 6
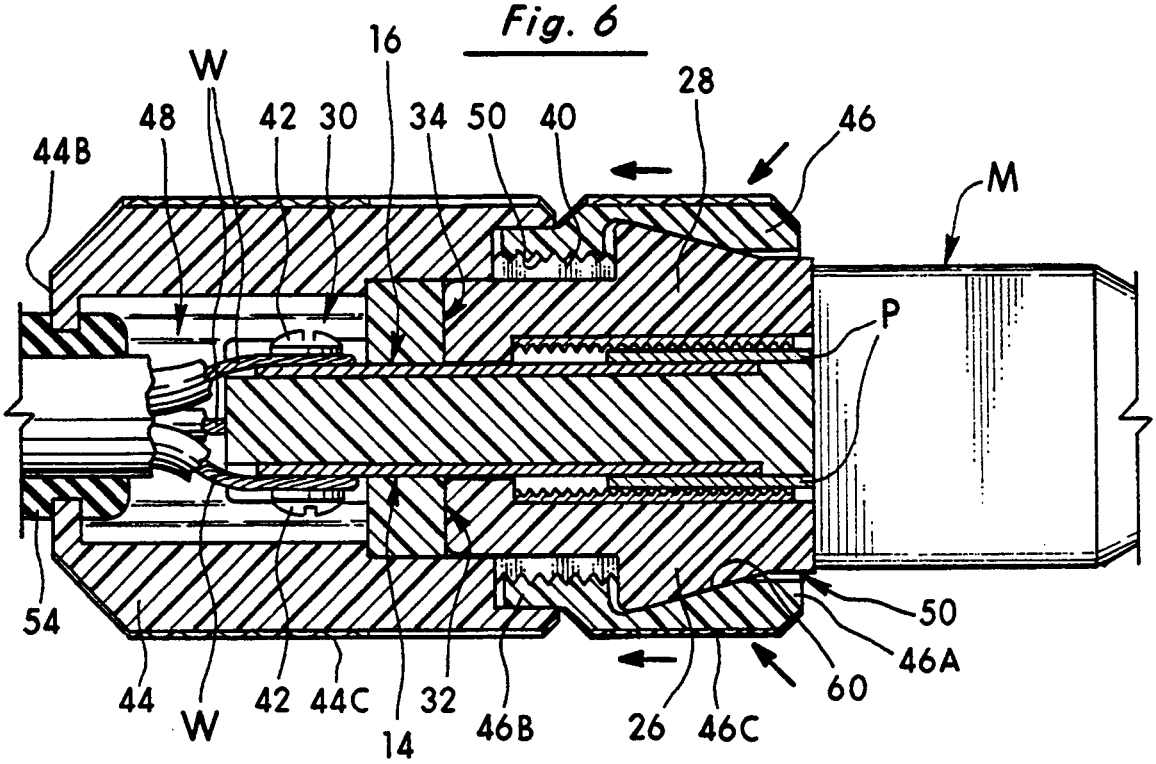
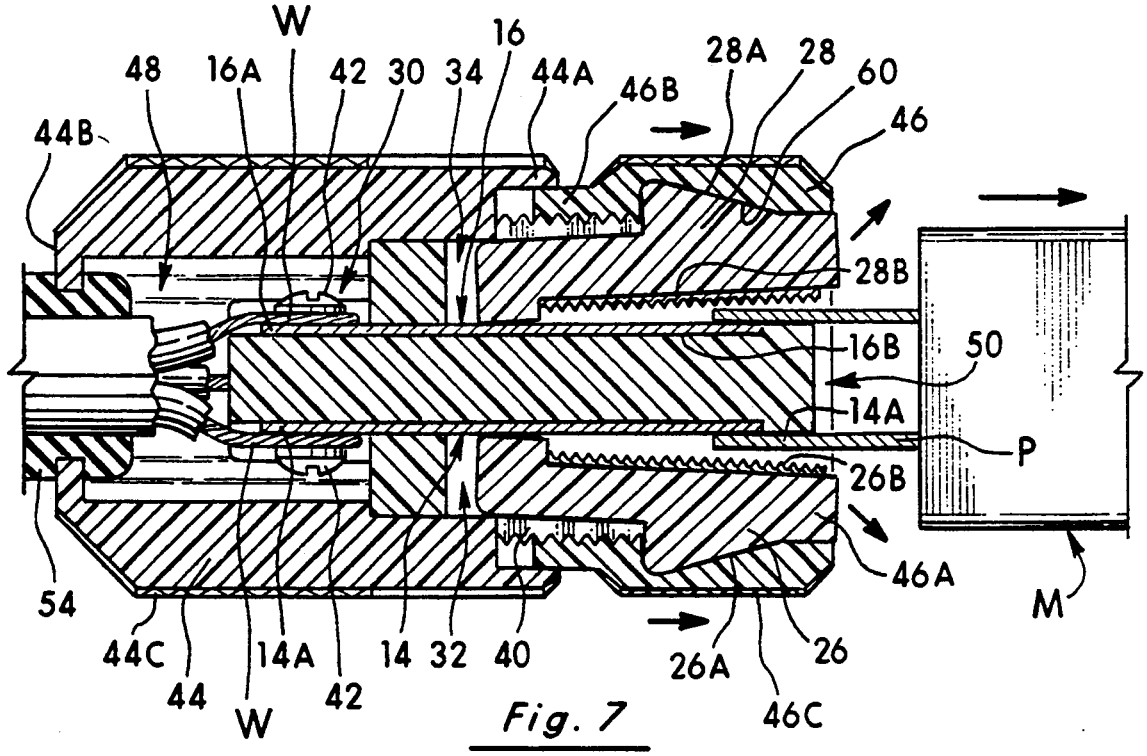
Fig. 7

FEMALE SOCKET-BASED MALE PLUG LOCKING DEVICE

BACKGROUND OF THE INVENTION

1. Field of the Invention

The present invention generally relates to male plug and female socket electrical connections and, more particularly, is concerned with a male plug locking device incorporated by a female electrical socket, for instance, on the end of an extension cord to prevent inadvertent disconnection of the male plug on the end of an electrical power cord of a power tool from the female socket on the extension cord.

2. Description of the Prior Art

All kinds of construction work require the use of many different types of electrical power tools. Some power tools are setup and used at stationary locations on the construction site while others are carried about the construction site by craftsmen so that the tools are available for use when needed in the performance of the different tasks.

Power tools typically utilize an electrical power cord with a male electrical plug on the end of the cord. Usually an electrical extension cord is used to supply the needed electrical power to the power tool from an electrical utility receptacle since the receptacle is ordinarily too distantly located from the power tool to directly connect the male plug on the power tool cord into the receptacle.

A frequent annoyance for the user of the power tool which causes an interruption that slows work progress is to have the male plug on the power cord of the tool be inadvertently pulled and disconnected from the female socket on the end of the extension cord. Specialized pairs of interlockable male plugs and female sockets are known in the prior art. However, in order to use them, the original male plug on the power tool cord and the original female socket on the extension cord must be removed and replaced by the specialized interlockable plug and socket components.

The disadvantage of this approach is that the specialized male plug on the power cord of the tool can not be used with a standard electrical female socket. Thus, as a result of the substitution, the utility of the power tool is diminished.

Consequently, a need exists for an approach to overcoming the aforementioned inadvertent disconnection problem without the necessity of having to exchange the male plug on the power cord of the tool.

SUMMARY OF THE INVENTION

The present invention provides a female socket-based male plug locking device designed to satisfy the aforementioned need. The male plug locking device of the present invention is advantageously incorporated in the place of a standard female socket on an extension cord. Such modified female socket will function to prevent inadvertent disconnection from the extension cord of a standard male plug provided on the end of the electrical cord of the power tool.

The provision of the female socket-based male plug locking device in the place of the standard female socket of the extension cord avoids the necessity of having to remove and replace the standard male plug on the power cord of the tool which would then prevent the male plug of the power tool from being plugged into a standard female socket. The male plug locking device of the present invention still permits the user, when desired, to plug the standard male plug on the electrical cord of the power tool directly into a standard female socket.

The present invention, therefore, provides a way to avoid inadvertent disconnnections from occurring and to do so by expanding the capability of the power tool cord rather than diminishing it. The objective of keeping the male plug on the power tool cord plugged into the female socket of an extension cord is achieved without modifying the male end of the cord.

Accordingly, the present invention is directed to a female-socket based male plug locking device which comprises: (a) an inner socket body; (b) electrical contact means disposed on the inner socket body for receiving and engaging contact prongs of a male plug and for providing electrical connections with ends of the conductor wires of an electrical cord; (c) an outer housing disposed over the inner socket body and overlying the contact means, the outer housing being mounted on the inner socket body to undergo movement relative thereto between first and second axially displaced positions; and (d) lock means disposed between the outer housing and inner socket body and overlying the electrical contact means and contact prongs of the male plug for respectively clamping the contact prongs against the electrical contact means and releasing the contact prongs from the electrical contact means in response to movement of the outer housing between the first and second axially displaced positions relative to the inner socket body so as to thereby prevent and permit disconnection of the male plug from the inner socket body.

More particularly, the inner socket body has a central axis and a plurality of longitudinal passages defined in an exterior surface of the inner socket body. The longitudinal passages are circumferentially spaced from one another about the inner socket body and extend axially and radially relative to the central axis thereof. The longitudinal passages of the inner socket body receive the electrical contact means and are adapted to receive a plurality of elongated electrical contact prongs of a male plug in overlying relation to the electrical contact means.

Also, the outer housing has a longitudinal axis and an annular internal surface extending about and being tapered axially along the longitudinal axis of the outer housing. The locking means includes a pair of locking cam elements each disposed in one of a pair of the passages in the inner socket body. Each of the locking cam elements has an outer inclined surface being complementary in configuration to the tapered internal surface of the outer housing such that the locking cam elements will move radially within the passages of the inner socket body relative to the central axis thereof for respectively clamping the contact prongs against the electrical contact means and releasing the contact prongs from the electrical contact means in response to movement of the outer housing between the first and second axially displaced positions relative to the inner socket body.

Further, the electrical contact means includes a plurality of elongated electrical contact elements having opposite terminal and contact portions. The terminal portions are mounted on an end portion of the inner socket body and adapted to be connected with ends of the conductor wires of the electrical cord to provide the electrical connections therewith. The contact portions extend within the longitudinal passages in the inner socket body and are adapted to engage the contact prongs of the male plug when received in the longitudinal passages of the inner socket body.

Additionally, the inner socket body also has an externally-threaded section defined about the exterior surface on the inner socket body. The outer housing has an internally-threaded section defined about the interior surface thereof adapting the outer housing to be threadable over the externally-threaded section of the inner socket body to undergo rotatable movement relative thereto between the first and second axially displaced positions.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 6 is a fragmentary longitudinal secitonal view, on a reduced scale, of the device taken along line 6—6 of FIG. 4, showing the device in a locked condition.

FIG. 7 is a fragmentary longitudinal sectional view similar to that of FIG. 6, but showing the device in a unlocked or released condition.

DETAILED DESCRIPTION OF THE INVENTION

Figure 1:
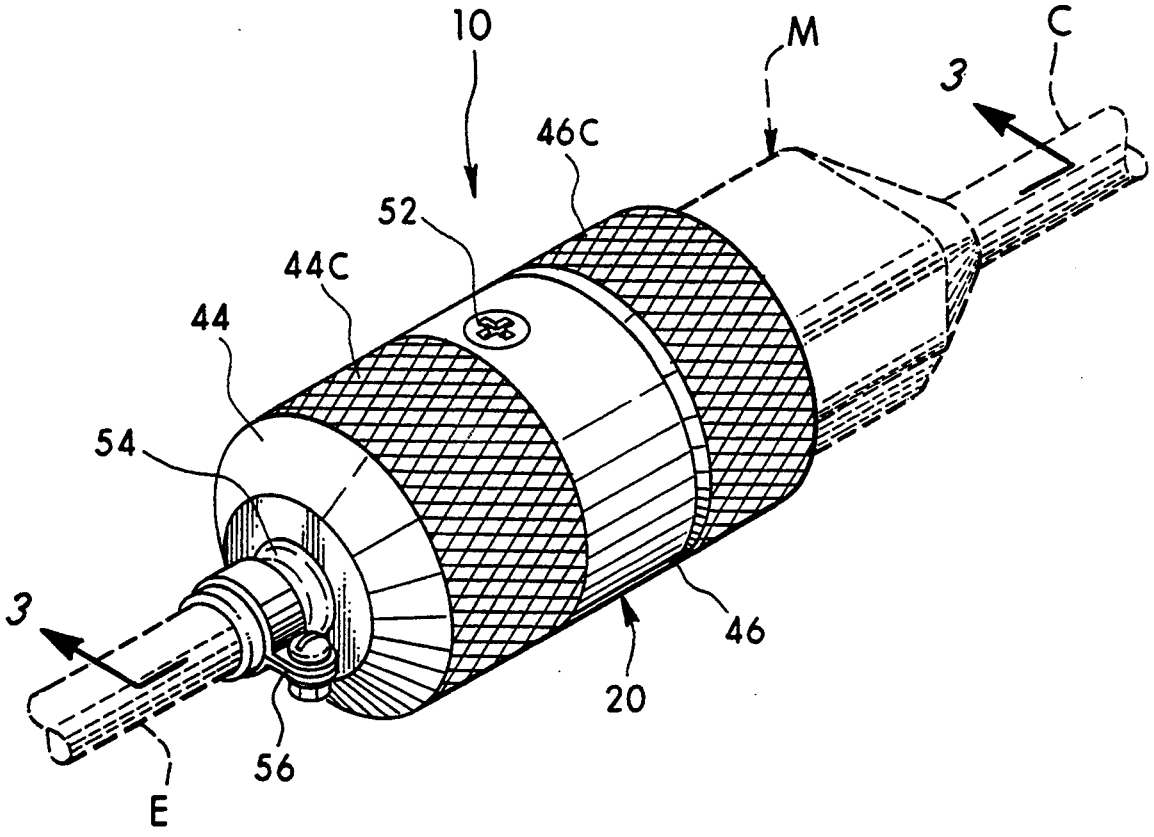
FIG. 1 is an assembled perspective view of a female socket-based male plug locking device in accordance with the present invention.
Figure 2:
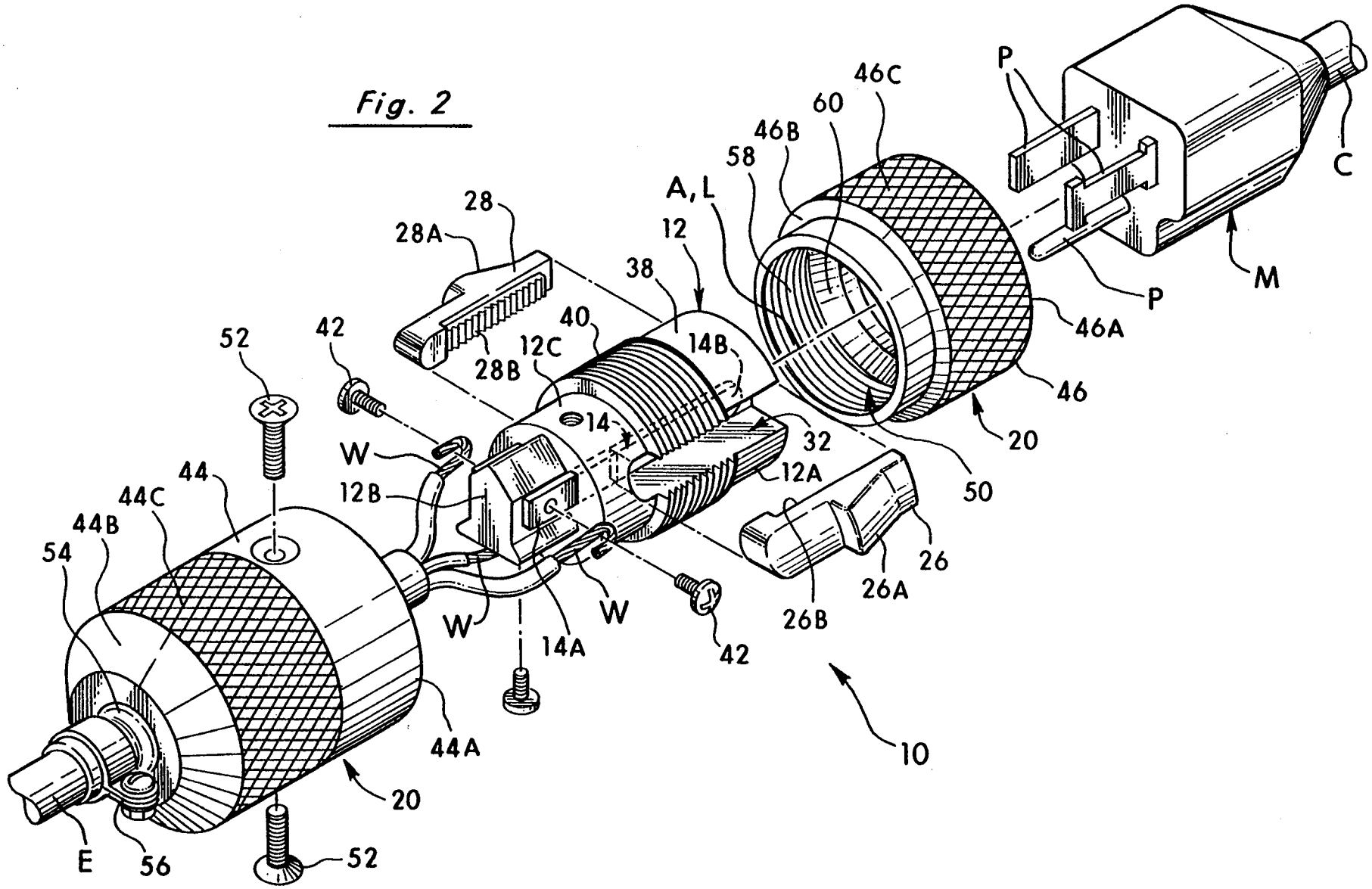
FIG. 2 is an exploded perspective view of the male plug locking device of FIG. 1.
Figure 3:
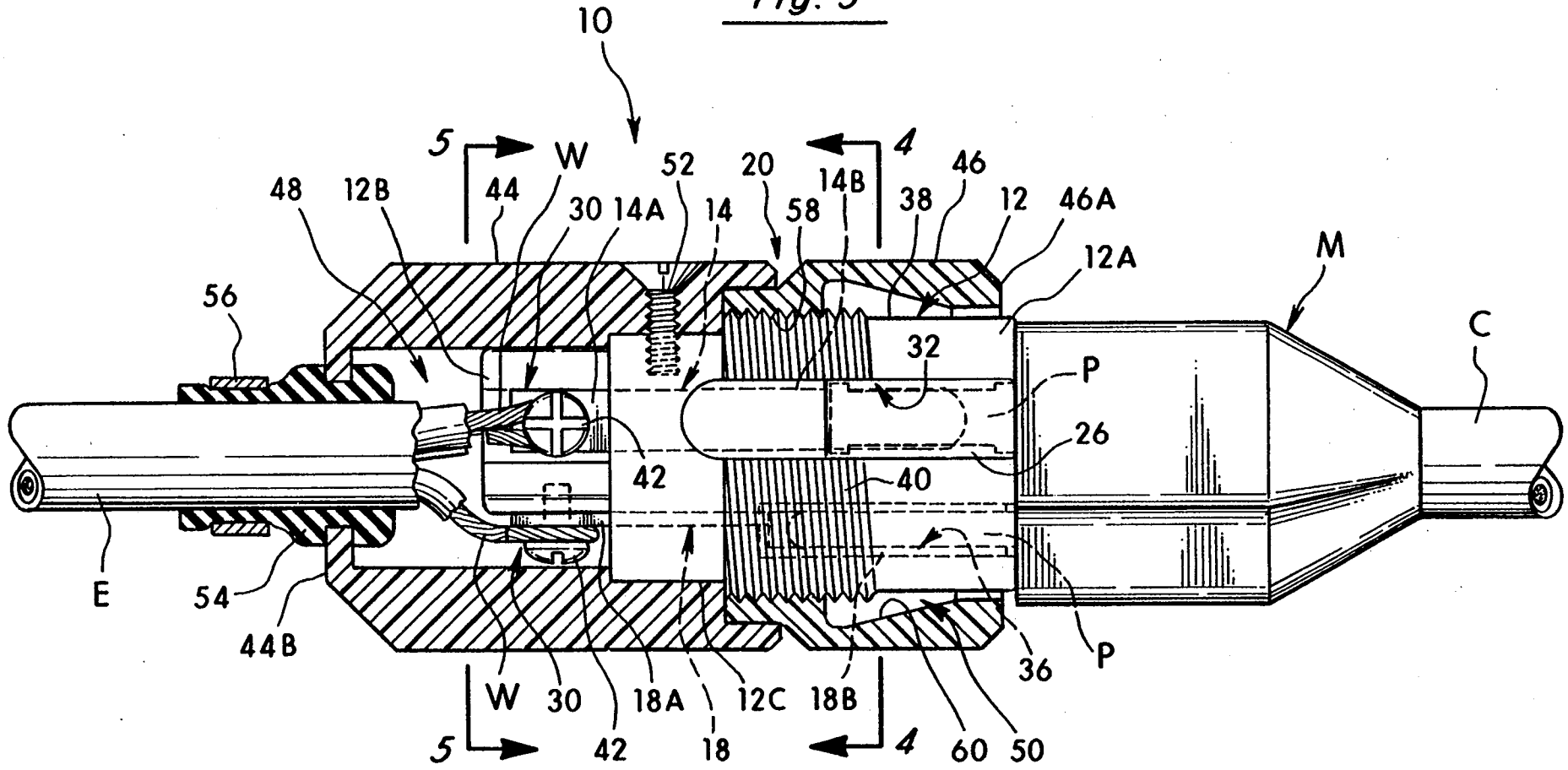
FIG. 3 is an enlarged longitudinal sectional view of the device taken along line 3—3 of FIG. 1.
Figure 4:
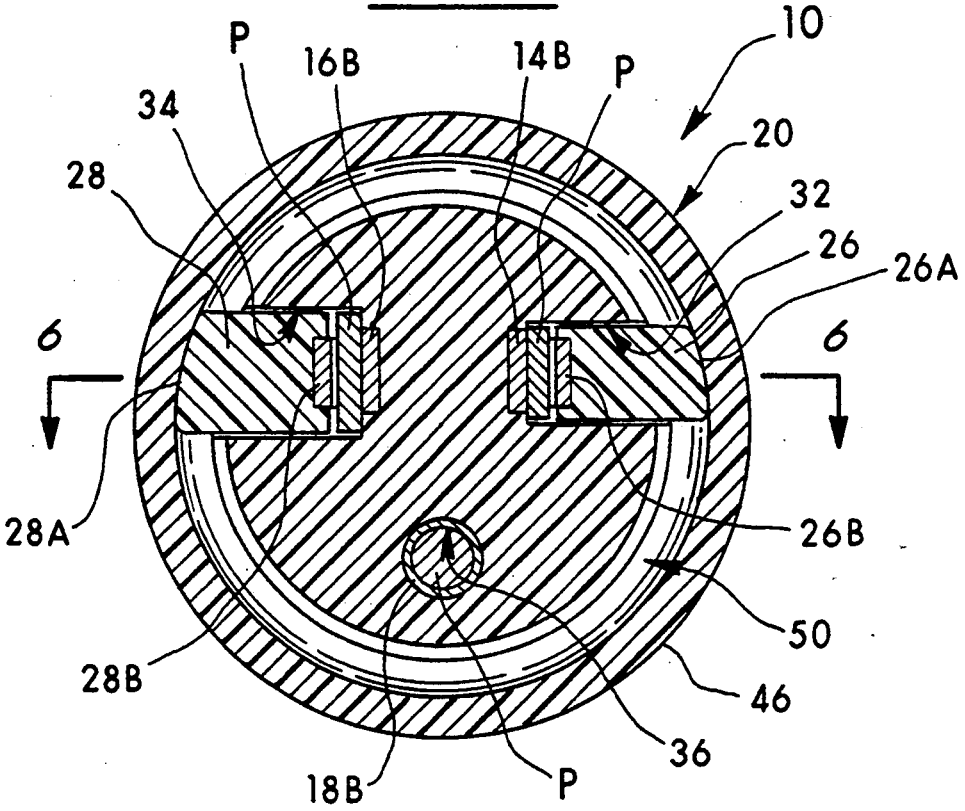
FIG. 4 is an enlarged cross-sectional view of the device taken along line 4—4 of FIG. 3.
Figure 5:
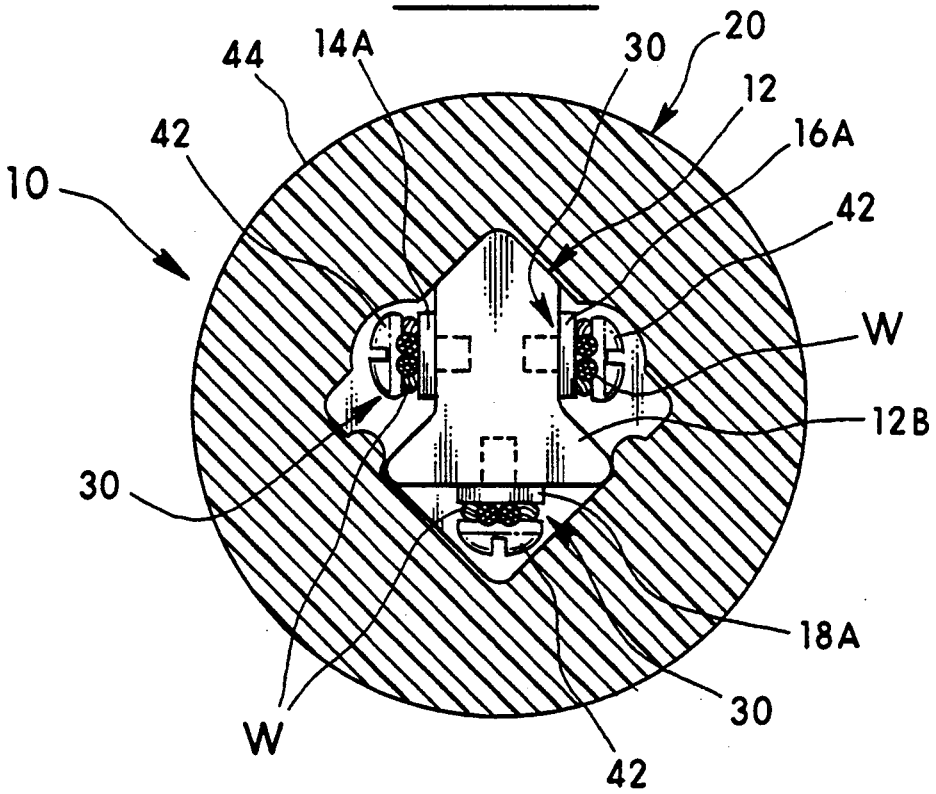
FIG. 5 is another enlarged cross-sectional view of the device taken along line 5—5 of FIG. 3.

Referring to the drawings and particularly to FIGS. 1 to 3, there is illustrated a female socket-based male plug locking device, generally designated 10, of the present invention. The male plug locking device 10 is adapted to be mounted on an end of an electrical power cord, such as an extension cord E, to prevent inadvertent disconnection of a male plug M on the end of another electrical power cord C, such as one on a power tool (not shown), from the female socket-based male plug locking device 10.

Basically, the female socket-based male plug locking device 10 includes an inner socket body 12, a plurality of elongated electrical contact elements 14, 16, 18 disposed on the inner socket body 12, an annular outer housing 20 over the inner socket body 12, and a pair of locking cam elements 26, 28 disposed between the inner socket body 12 and the outer housing 20. The inner socket body 12 is configured to mount the electrical contact elements 14, 16, 18 and to receive and engage contact prongs P of the male plug M with the contact elements 14, 16, 18 and to provide electrical connections 30 between the electrical contact elements 14, 16, 18 and the ends of the conductor wires W of the electrical extension cord E. The outer housing 20 is mounted on the inner socket body 12 to undergo movement relative thereto between first and second axially displaced positions, as seen in FIGS. 6 and 7. The locking cam elements 26, 28 overlie a pair of the electrical contact elements 14, 16 on the inner socket body 12 and overlie the contact prongs P of the male plug M and are operable for respectively clamping the contact prongs P against the electrical contact elements 14, 16 and for releasing the contact prongs P from the electrical contact elements 14, 16 in response to movement of the outer housing 20 between the first and second axially displaced positions relative to the inner socket body 12. In such manner, the outer housing 20 and the locking cam elements 26, 28 are cooperate together to selectively prevent and permit disconnection of the contact prongs P of the male plug M from the contact elements 14, 16, 18 of the inner socket body 12. Referring to FIGS. 2–7, the inner socket body 12 of the locking device 10 has front and rear opposite end portions 12A, 12B and a middle portion 12C located therebetween. The inner socket body 12 also includes a plurality of longitudinal passages 32, 34, 36 angularly spaced from one another about a central axis A of the inner socket body 12 and extending axially through the inner socket body 12 from the front opposite end portion 12A through the middle portion 12C and toward the rear opposite end portion 12B thereof. A pair of the longitudinal passages 32, 34 are circumferentially spaced from one another about the inner socket body 12 and extend axially and radially relative to the central axis A thereof from the exterior surface 38 of the inner socket body 12. The respective longitudinal passages 32, 34, 36 of the inner socket body 12 receive therein the electrical contact elements 14, 16, 18 and the electrical contact prongs P of the male plug P in an overlying relation to the electrical contact elements. The inner socket body 12 also has an externally-threaded section 40 defined about the exterior surface 38 on the middle portion 12C of the inner socket body 12 and between the front and rear opposite end portions 12A, 12B of the inner socket body 12.

Referring to 2–7, the elongated electrical contact elements 14, 16 and 18 of the locking device 10 each have respective opposite terminal and contact portions 14A, 14B, 16A, 16B and 18A, 18B. The terminal portions 14A, 16A, 18A of the contact elements 14, 16, 18 are mounted on the rear opposite end portion 12B of the inner socket body 12 and are electrically connected by screws 42 with respective ends of the conductor wires W of the extension cord E. On the other hand, the contact portions 14B, 16B, 18B of the contact elements 14, 16, 18 extend axially through the middle portion 12C of the inner socket body 12 and within the longitudinal passages 32, 34, 36 extending therein and through the front opposite end portion 12A of the inner socket body 12. The contact portions 14B, 16B, 18B of the respective contact elements 14, 16, 18 are thereby adapted to electrically engage the contact prongs P of the male plug M when they are received in the passages of the inner socket body 12 of the locking device 10.

Referring to FIGS. 1–7, the annular outer housing 20 of the locking device 10 has a longitudinal axis L and includes an annular base body 44 and an annular actuator body 46 disposed over the inner socket body 12 in a tandem relationship to one another along the longitudinal axis L. The annular base body 44 has a central cavity 48 therethrough being open at opposite ends 44A, 44B of the annular base body 44. The annular actuator body 46 has a central bore 50 therethrough being open at opposite ends of the annular actuator body 46. Also, each of the annular base and actuator bodies 44, 46 have a grippable knurled external surface portion 44C, 46C.

The rear end portion 12B of the inner socket body 12 is received in the central cavity 48 of the annular base body 44 through the front open end 44A thereof. Also, the annular base body 44 is attached by screws 52 to the rear end portion 12B of the inner socket body 12 so as to be rotatably immovable relative thereto. The annular base body 44 receives the ends of conductor wires W of the extension cord E through the rear open end 44B and into the central cavity 48. A strain relief collar 54 and clamp 56 are employed to anchor the cord E to the rear end 44B of the base body 44.

The front end portion 12A of the inner socket body 12 is received in the central bore 50 of the annular actuator body 46 through the rear open end 46B thereof. The annular actuator body 46 has an internal surface 46C with an internally-threaded section 58 formed on a rear end portion thereof which is threadable over the externally-threaded section 40 of the inner socket body 12 and a progressively tapered section 60 formed on a forward end portion thereof which extends forwardly from the internally-threaded section 58 and axially along the longitudinal axis L of the outer housing 20.

Referring to FIGS. 2–7, as mentioned above, the pair of locking cam elements 26, 28 of the locking device 10 are disposed in respective ones of the longitudinal passages 32, 34 in the inner socket body 12. Each locking cam element 26, 28 has an outer inclined surface 26A, 28A being complementary in configuration to the progressively tapered internal surface section 60 on the annular actuator body 46. Thus, the respective locking cam elements 26, 28 will be moved radially within the respective passages 32, 34 toward and away from the contact prongs P of the male plug M, as shown respectively in FIGS. 6 and 7, in response to rotation of the annular actuator body 46 about the inner socket body 12 and thereby in response to axial movement of the annular actuator body 46 along the inner socket body 12, between the rearward and forward displaced positions seen in FIGS. 6 and 7. Such movement is caused by the threaded engagement of the externally-threaded section 40 of the inner socket body 12 with the internally-threaded section 58 of the annular actuator body 46 which imposes or withdraws an axially-directed force on the locking cam elements 26, 28 that causes them to clamp against or release from the contact prongs P of the male plug M inserted in the inner socket body 12 so as to thereby prevent or permit the disconnection of the male plug M from the locking device 10. The locking cam elements 26, 28 have knurled inner surfaces 26B, 28B which tend to grip the surfaces of the contact prongs P of the male plug M when clamped thereagainst.

To use the assembled male plug locking device 10 simply insert the contact prongs P of the male plug M into the corresponding longitudinal passages 32, 34, 36 of the inner socket body 12 of the locking device 10 and by gripping the respective cylindrical knurled surface portions 44C, 46C of the annular base and actuator bodies 44, 46 of the outer housing 20 of the locking device 10, the annular actuator body 46 can be easily rotated relative to the annular base body 44 and inner socket body 12 to clamp the male plug contact prongs P against the electrical contact elements 14, 16. In normal use, such rotation would require less than one-half of a complete revolution to either lock or release the male plug M.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A male plug locking device, comprising:

(a) an inner socket body;

(b) electrical contact means disposed on said inner socket body for receiving and engaging contact prongs of a male plug and for providing electrical connections with ends of conductor wires of an electrical cord;

(c) an outer housing disposed over and surrounding said inner socket body and overlying said contact means, said outer housing being mounted on said inner socket body to undergo movement relative thereto between first and second axially displaced positions; and (d) locking means disposed between said outer housing and said inner socket body and overlying said electrical contact means and the contact prongs of the male plug for respectively clamping the contact prongs against said electrical contact means and releasing the contact prongs from said electrical contact means in response to movement of said outer housing between said first and second axially displaced positions relative to said inner socket body so as to thereby prevent and permit disconnection of the male plug from said inner socket body.

2. The device of claim 1 wherein said inner socket body has an externally-threaded section defined about an exterior surface on said inner socket body.

3. The device of claim 2 wherein said outer housing has an internally-threaded section defined about an interior surface thereof adapting said outer housing to be threadable over said externally-threaded section of said inner socket body to undergo rotatable movement relative thereto between said first and second axially displaced positions.

4. The device of claim 1 wherein said inner socket body has a central axis and a plurality of longitudinal passages defined in an exterior surface of said inner socket body and being circumferentially spaced from one another about said inner socket body and extending axially and radially relative to said central axis thereof, said passages of said inner socket body receiving therein said electrical contact means and being adapted to receive therein a plurality of elongated electrical contact prongs of a male plug in overlying relation to said electrical contact means.

5. The device of claim 4 wherein said outer housing has a longitudinal axis and an annular internal surface extending about and being tapered axially along said longitudinal axis of said outer housing.

6. The device of claim 5 wherein said locking means includes a pair of locking cam elements each disposed in one of a pair of said passages in said inner socket body, each of said locking cam elements having an outer inclined surface being complementary in configuration to said tapered internal surface of said outer housing such that said locking cam elements will move radially within said passages of said inner socket body relative to said central axis thereof for respectively clamping the contact prongs against said electrical contact means and releasing the contact prongs from said electrical contact means in response to movement of said outer housing between said first and second axially displaced positions relative to said inner socket body.

7. The device of claim 4 wherein said electrical contact means includes a plurality of elongated electrical contact elements having opposite terminal and contact portions, said terminal portions being mounted on an end portion of said inner socket body and adapted to be connected with ends of the conductor wires of the electrical cord to provide said electrical connections therewith, said contact portions extending within said longitudinal passages in said inner socket body and being adapted to engage the contact prongs of the male plug when received in said longitudinal passages of said inner socket body.

8. The device of claim 4 wherein said inner socket body also has an externally-threaded section defined about an exterior surface on said inner socket body.

9. The device of claim 8 wherein said outer housing has an internally-threaded section defined about an interior surface thereof adapting said outer housing to be threadable over said externally-threaded section of said inner socket body to undergo rotatable movement relative thereto between said first and second axially displaced positions.

10. The device of claim 1 wherein said outer housing includes an annular base body and an annular actuator body disposed in a tandem relationship to one another over said inner socket body, said annular base body having a central cavity therethrough being open at opposite ends of said annular base body, said annular actuator body having a central bore therethrough being open at opposite ends of said annular actuator body.

11. The device of claim 10 wherein each of said annular base and actuator bodies having a knurled external surface portion.

12. The device of claim 10 wherein said annular base body of said outer housing receives an end portion of said inner socket body in said cavity of said annular base body through one of said opposite ends thereof, said annular base body being attached to said end portion of said inner socket body so as to be rotatably immovable relative thereto, said annular base body also being capable of receiving ends of conductor wires of a power cord into said cavity of said base body through the other of said opposite ends thereof to provide said electrical connections with said electrical contact means.

13. The device of claim 12 wherein said inner socket body has an externally-threaded section defined about an exterior surface on an opposite end portion thereof said inner socket body.

14. The device of claim 13 wherein said annular actuator body of said outer housing has an internally-threaded section defined about an interior surface thereof adapting said annular actuator body to be threadable over said externally-threaded section of said inner socket body to undergo rotatable movement relative thereto between said first and second axially displaced positions.

15. The device of claim 10 wherein said inner socket body has a central axis and a plurality of longitudinal passages defined in an exterior surface of said inner socket body and being circumferentially spaced from one another about said inner socket body and extending axially and radially relative to said central axis thereof, said passages of said inner socket body receiving therein said electrical contact means and being adapted to receive therein a plurality of elongated electrical contact prongs of a male plug in overlying relation to said electrical contact means.

16. The device of claim 15 wherein said annular actuator body of said outer housing has a longitudinal axis and first and second annular internal surfaces arranged in tandem relation to one another and extending about and along said longitudinal axis of said outer housing, said first annular surface having an internally-threaded section formed thereon, said second annular surface being tapered axially along said longitudinal axis of said outer housing.

17. The device of claim 16 wherein said inner socket body also has an externally-threaded section defined about said exterior surface on said inner socket body and being threadably coupled with said internally-threaded section formed on said annular actuator body of said outer housing thereby adapting said annular actuator body of said outer housing to undergo rotatable movement between said first and second axially displaced positions relative to said inner socket body and to said annular base body of said outer housing.

18. The device of claim 17 wherein said locking means includes a pair of locking cam elements each disposed in one of a pair of said passages in said inner socket body, each of said locking cam elements having an outer inclined surface being complementary in configuration to said tapered internal surface of said annular actuator body of said outer housing such that said locking cam elements will move radially within said passages of said inner socket body relative to said central axis thereof for respectively clamping the contact prongs against said electrical contact means and releasing the contact prongs from said electrical contact means in response to rotational movement of said annular actuator body of said outer housing between said first and second axially displaced positions relative to said inner socket body and to said annular base body of said outer housing.

19. The device of claim 18 wherein said electrical contact means includes a plurality of elongated electrical contact elements having opposite terminal and contact portions, said terminal portions being mounted on an end portion of said inner socket body and adapted to be connected with ends of the conductor wires of the electrical cord to provide said electrical connections therewith, said contact portions extending within said longitudinal passages in said inner socket body and being adapted to engage the contact prongs of the male plug when received in said longitudinal passages of said inner socket body.

20. A male plug locking device, comprising:

(a) an inner socket body having first and second opposite end portions and a plurality of longitudinal passages extending partially through said inner socket body axially from said first opposite end portion toward said second opposite end portion thereof and radially from an interior region to an exterior surface of said inner socket body, said passages of said inner socket body being adapted to receive therein a plurality of elongated electrical contact prongs of a male plug, said inner socket body also having an externally-threaded section defined about said exterior surface on a middle portion of said inner socket body and between said first and second opposite end portions thereof;

(b) a plurality of elongated electrical contact elements having opposite terminal and contact portions, said terminal portions of said electrical contact elements being mounted on said second opposite end of said socket body and adapted to be connected with ends of conductor wires of an electrical cord, said contact portions of said contact elements extending through said middle portion of said socket body and within said longitudinal passages therein, said contact portions of said contact elements being adapted to engage the contact prongs of the male plug when received in said longitudinal passages of said socket body;

(c) an outer housing having an annular base body and an annular actuator body disposed over said inner socket body in a tandem relationship to one another, said annular base body having a central cavity therethrough being open at opposite ends of said annular base body, said annular actuator body having a central bore therethrough being open at opposite ends of said annular actuator body, each of said annular base and actuator bodies having a grippable external surface portion, said annular base body receiving said second opposite end portion of said inner socket body in said cavity of said annular base body through one of said opposite ends thereof and being attached to said inner socket body so as to be rotatably immovable relative thereto, said annular base body capable of receiving ends of conductor wires into said cavity of said annular base body through the other of said opposite ends thereof, said annular actuator body receiving said first opposite end portion of said inner socket body in said bore of said annular actuator body through one of said opposite ends thereof, said annular actuator body having first and second opposite end portions, an internally-threaded section formed on said first opposite end portion being threaded over said externally-threaded section of said inner socket body and an internal surface formed on said second opposite end portion being tapered from said internally-threaded section to the other of said opposite ends of said annular actuator body; and (d) a plurality of locking cam elements each disposed in one of at least a pair of said passages through said inner socket body, each of said locking cams having an outer inclined surface being complementary in configuration to said tapered internal surface of said annular actuator body such that said locking cam elements will move radially within said passages of said inner socket body and relative to said contact prongs of the male plug when received in said passages of said inner socket body in response to rotation of said annular actuator body about said inner socket body and thereby to axial movement of said annular actuator body along said inner socket body due to said threaded engagement of said externally-threaded section of said inner socket body with said internally-threaded section of said annular actuator body so as to impose or withdraw an axially-directed force on said locking cam elements that causes said locking cam elements to grasp or release the contact prongs of the male plug inserted in said inner socket body and thereby prevent or permit the disconnection of the male plug from said inner socket body.

* * * * *